United States Patent [19]

Sampon

[11] 3,961,434

[45] June 8, 1976

[54] ANIMATED SIGN

[75] Inventor: Edward A. Sampon, Milwaukee, Wis.

[73] Assignee: Everbrite Electric Signs, Inc., South Milwaukee, Wis.

[22] Filed: Nov. 18, 1974

[21] Appl. No.: 524,595

[52] U.S. Cl. ..... 40/106.53; 40/36

[51] Int. Cl.[2] ..... G09F 13/34

[58] Field of Search..... 40/106.53, 106.52, 106.51, 40/36, 28 C, 137, 130 E, 132 F, 133 A

[56] References Cited

UNITED STATES PATENTS

| | | | |
|---|---|---|---|
| 1,114,267 | 10/1914 | Jones | 40/28 C |
| 1,172,360 | 2/1916 | Hildburgh | 40/28 C |
| 1,594,703 | 8/1926 | Ballerini | 40/28 C |
| 2,982,038 | 5/1961 | Kass | 40/130 E X |
| 3,082,560 | 3/1963 | Elvestrom | 40/106.51 X |
| 3,643,361 | 2/1972 | Eaves | 40/106.53 |
| 3,747,243 | 7/1973 | Schneider | 40/106.53 X |
| 3,827,797 | 8/1974 | Eaves | 40/106.53 X |

*Primary Examiner*—Louis G. Mancene
*Assistant Examiner*—John F. Pitrelli
*Attorney, Agent, or Firm*—Arthur L. Morsell, Jr.

[57] ABSTRACT

Two panels each having an opaque background with an array of transparent dots therein are superimposed in front of a light source. The array of transparent dots in one panel is arranged to form a rectangular grid while the transparent dots in the other panel are positioned along the diagonal lines of the rectangular grid. Three transparent dots are positioned along the diagonal line between diagonally opposite pairs of transparent dots on the rectangular grid. The transparent dots along the diagonal lines are arranged to form three separate patterns, each of which may be a letter, a word or group of words, a picture, or a design. One of the panels is periodically reciprocated along the diagonal lines relative to the other panel, which causes the three separate patterns to be illuminated in sequence, each illuminated pattern being extinguished before the next pattern is illuminated. Illumination occurs when the transparent dots forming the pattern register with the transparent dots of the rectangular grid, thus allowing light to pass through the registered dots.

5 Claims, 21 Drawing Figures

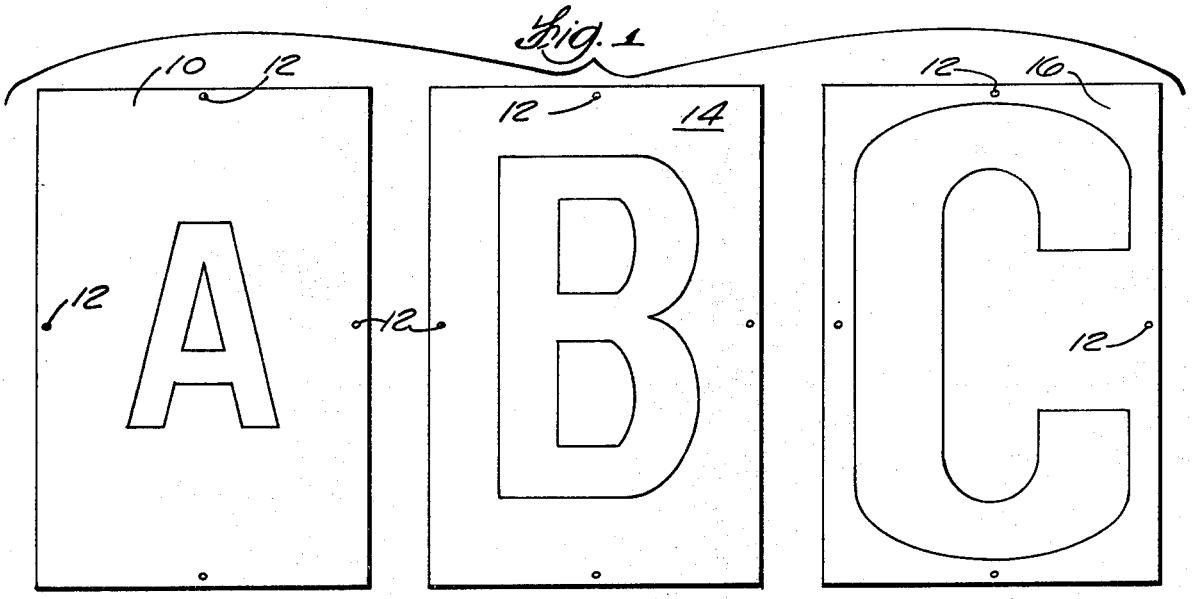
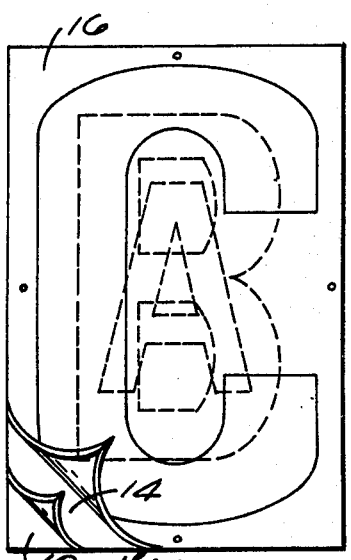
Fig. 2
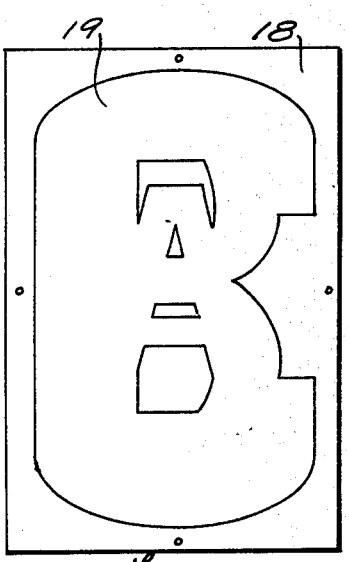
Fig. 3
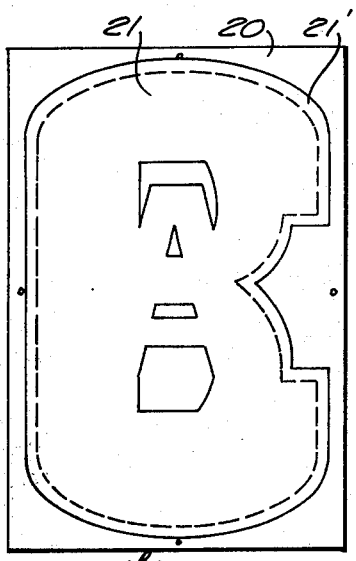
Fig. 4
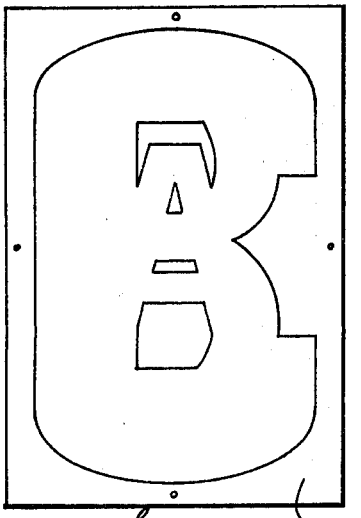
Fig. 5
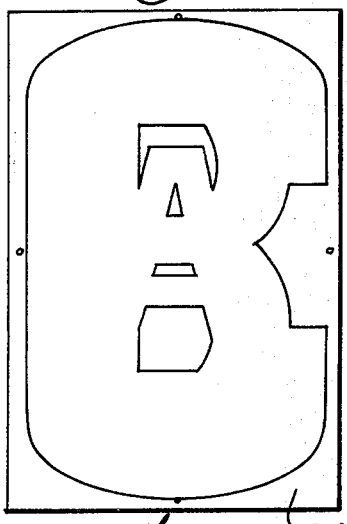
Fig. 6
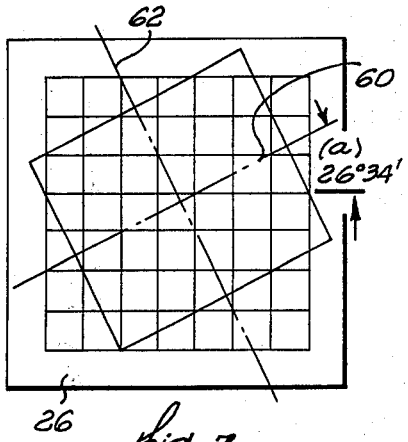
Fig. 7

Fig. 15
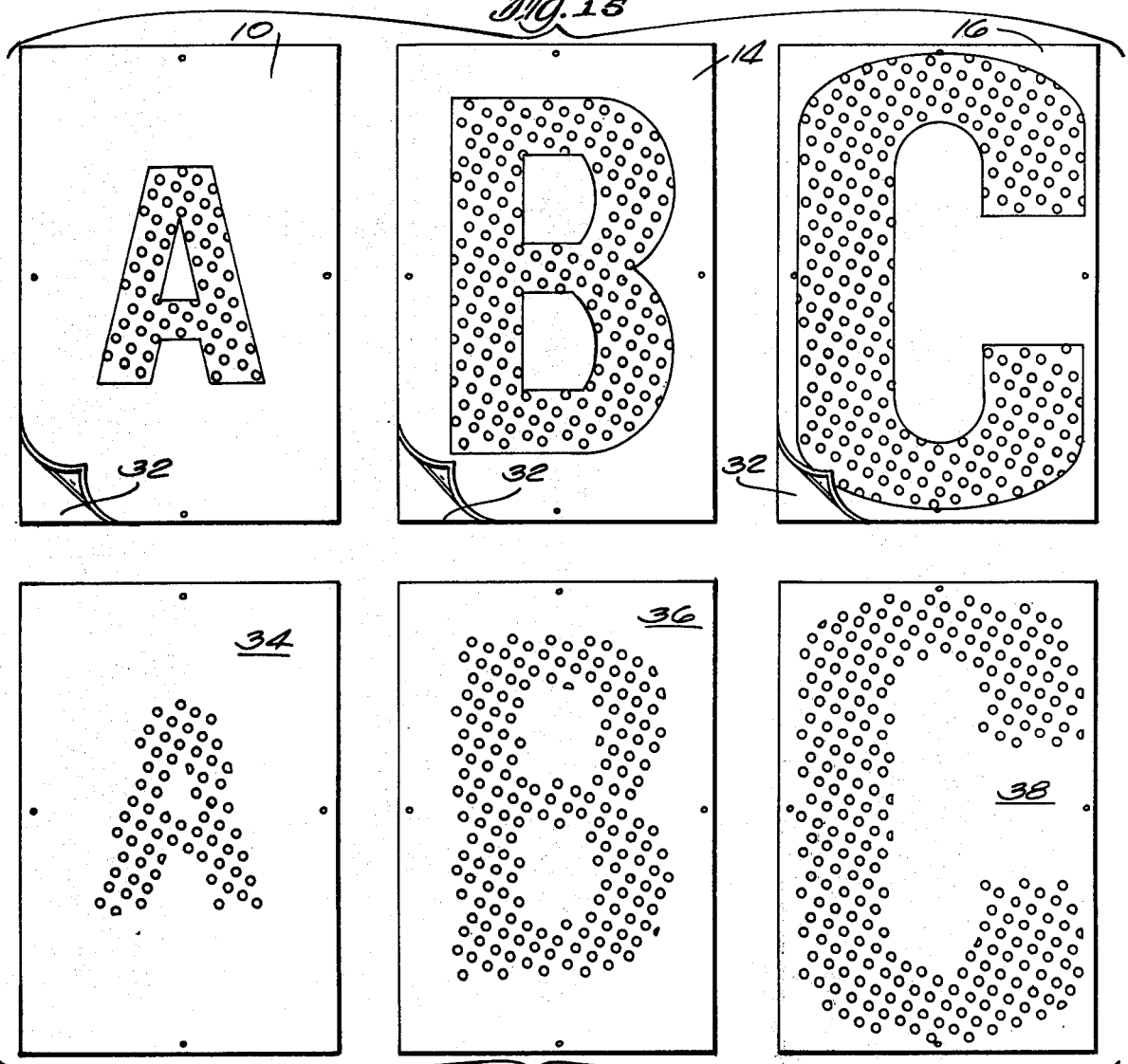
Fig. 16
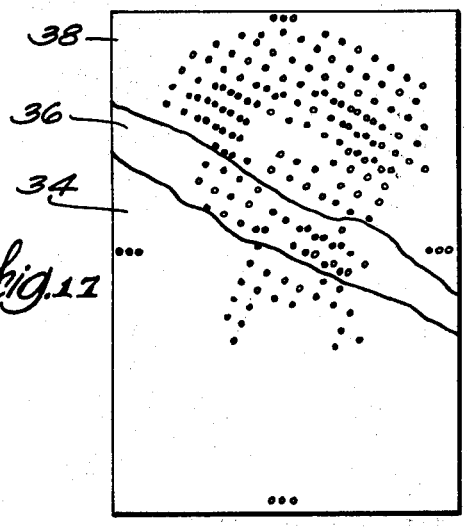
Fig. 17
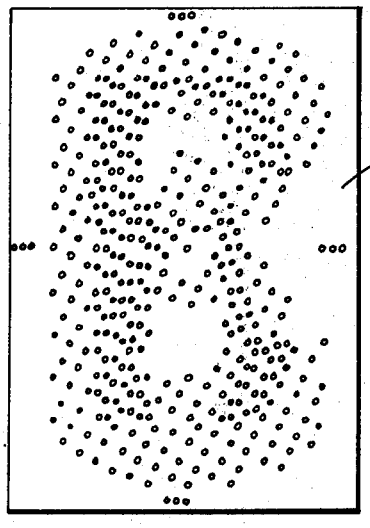
Fig. 18

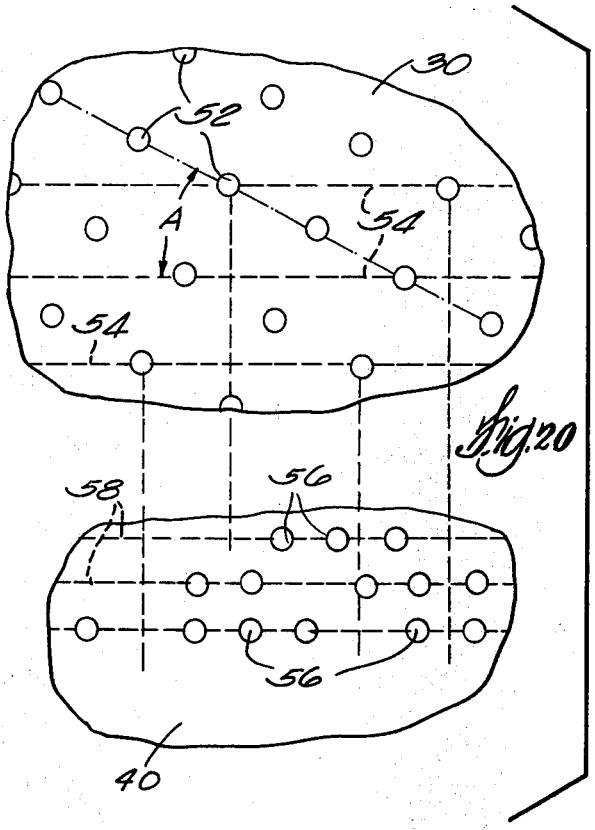
Fig. 20
Fig. 21
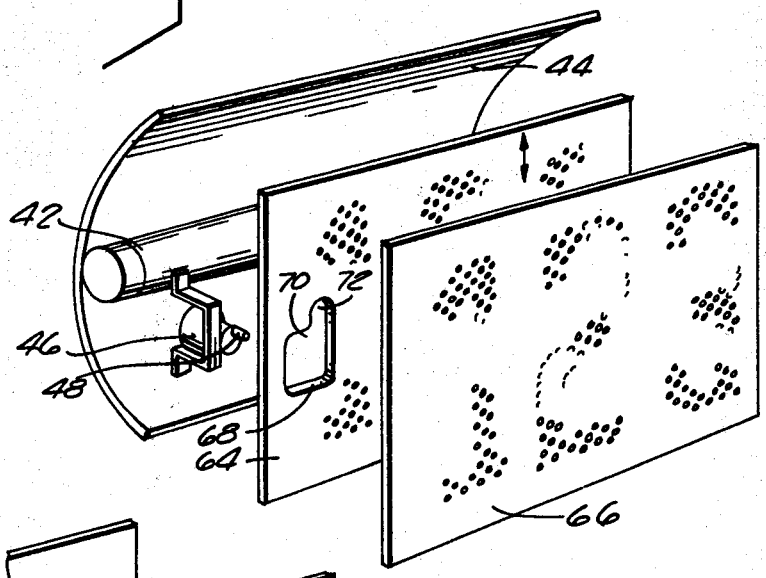
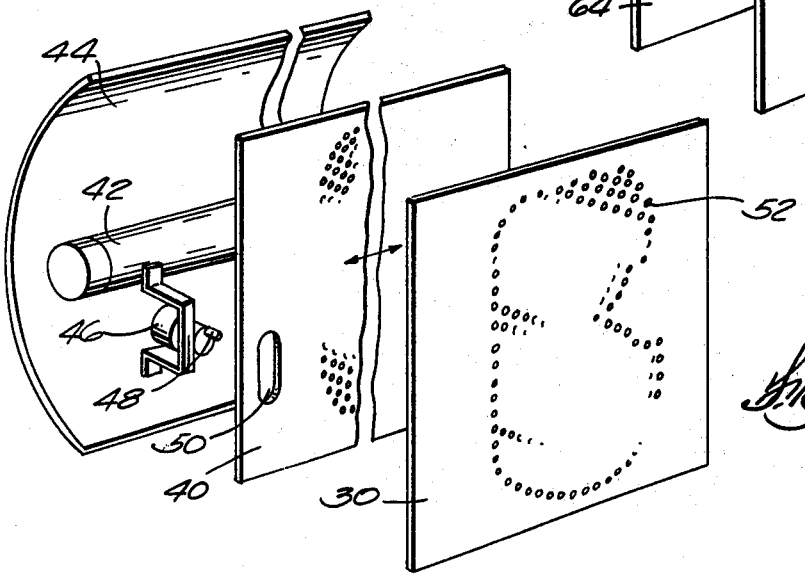
Fig. 19

ANIMATED SIGN

BACKGROUND OF THE INVENTION

This invention relates to illuminated animated signs of the type that employ two superimposed panels each having an opaque background with transparent dots therein, the transparent dots of one panel being arranged to form patterns that are illuminated when the dots in the two panels register to allow light to pass therethrough. A typical prior art animated sign of this general type is disclosed in U.S. Pat. No. 3,783,539 to C. E. Trame et al. This sign has a substantially rectangular grid of transparent dots in one panel and an array of circularly disposed transparent dots in the other panel, there being a circle of dots for each single dot in the rectangular grid. The panel bearing the circularly disposed dots is orbited in a circular path with respect to the other panel so that each circle of transparent dots passes in succession over the corresponding dot of the rectangular grid. The circularly disposed dots are arranged to present a pattern representing numbers showing the time of day, and the orbital panel is driven at a predetermined speed to digitally display the correct time minute by minute. Each digit of the display is formed by an array of lighted dots which result from registration between dots of the rectangular grid and the circularly disposed dots.

Although the above-described prior art sign is workable in connection with digital clocks, the requirement of having a circle of dots in one panel for each dot in the other panel results in a grid having intersections which are too far apart to be effectively used for letters, words, pictures, and the like, particularly in signs that are to be observed from relatively short distances such as encountered in point of purchase displays.

SUMMARY OF THE INVENTION

In accordance with this invention, it has been found that the density of the display grid used in the above-described type of animated sign can be substantially increased by disposing the transparent dots of one panel on the diagonals of two adjacent squares of the grid of the other panel rather than in circles around each dot of the grid. One of the panels is reciprocated along the diagonal either by exerting side to side or up and down motion. This substantially simplifies the mounting of the movable panel compared to an orbital movement and also simplifies the means for moving the panel. The grid with closely spaced dots which is provided by this invention can be used for letters, words or sentences, pictures, designs, etc., and is as visually effective for short range signs as for long range signs. The letters or words can be illuminated in sequence and many different special effects can be obtained such as enlarging or lengthening the letters, expanding a design, etc.

DESCRIPTION OF THE DRAWINGS

FIG. 1 is a plan view of masks of three different letters which are to be formed in one embodiment of the invention.

FIG. 2 is a plan view of the three masks of FIG. 1 superimposed one above the other.

FIG. 3 is a plan view of a mask with a first composite form defining the shape of the composite masks of FIG. 2.

FIG. 4 is a plan view of a mask with a second composite form similar to that of FIG. 3 but having an enlarged border to allow reciprocal movement.

FIG. 5 is a plan view of a composite mask which is a negative photographic impression of the mask shown in FIG. 3.

FIG. 6 is a plan view of a composite mask which is a negative photographic impression of the mask shown in FIG. 4.

FIG. 7 is a plan view of a sheet of material having a rectangular grid which is used as a pattern in fabricating an embodiment of the invention.

FIG. 15 is a plan view showing three copies of the mask of FIG. 14 with the three masks of FIG. 1 superimposed thereon.

FIG. 16 is a plan view of masks having photographic negative impressions of the dotted masks shown in FIG. 14.

FIG. 17 is a plan view of the dotted masks of FIG. 16 superimposed one on top of one another and aligned with the different diagonal positions shown in FIGS. 8 and 9 to form a composite dotted mask.

FIG. 18 is a plan view of a mask having a photographic negative impression of the composite dotted mask of FIG. 17.

FIG. 19 is an exploded perspective view of a first embodiment of the invention utilizing a face panel similar to FIG. 13 and an animater panel similar to FIG. 18.

FIG. 20 is a plan view of an enlarged portion of the face panel of FIG. 13 and of the animater panel of FIG. 19 as used in FIG. 19.

FIG. 21 is an exploded perspective view of a second embodiment of the invention.

DESCRIPTION OF THE PREFERRED EMBODIMENT

Figure 8:
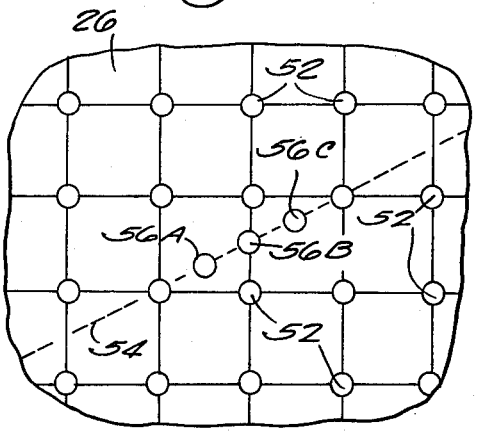
FIG. 8 is a plan view of an enlarged portion of the grid shown in FIG. 7 with a pattern of holes superimposed thereon to illustrate the pattern of transparent dots on the panels of this invention.

FIGS. 1 – 18 illustrate the steps involved in making the panels for one embodiment of the invention, and FIG. 19 illustrates the structure of that embodiment. This embodiment includes a face panel 30 (FIG. 19) which has an opaque background with an array of transparent dots thereon, and an animater panel 40 which has an opaque background with an array of transparent dots thereon. Panels 30 and 40 are superimposed in front of a lamp 42 and curved reflector 44 by conventional means not shown. Animater panel 40 is suitably mounted for horizontal sliding movement relative to face panel 30 by conventional means not shown, and is horizontally reciprocated by an electric motor 46 which rotates an eccentric drive pin 48 that engages a vertical slot 50 in animater panel 40. As animater panel 40 reciprocates behind stationary face panel 30, the transparent dots in panels 30 and 40 register periodically to form three different patterns which are illuminated in sequence. In this particular case, the three patterns form the letters A, B, and C, which appear in sequence on face panel 30 as the appropriate transparent dots register in panels 30 and 40. The opaque background has not been indicated on the drawings as it might confuse the views, but it is to be understood that the dots on panels 30 and 40 are transparent and everything else is opaque.

One of the principal novel features of this invention resides in the way that the transparent dots in animater panel 40 are arranged relative to the transparent dots in face panel 30. FIG. 20 shows the general arrangement of transparent dots in the two panels 30 and 40. The transparent dots 52 of face panel 30 are arranged in a rectangular grid pattern which in use, as in FIG. 19, is tilted at an angle A (FIG. 20) to the horizontal so that the diagonal lines 54, connecting diagonally opposite corners X of two adjacent grid squares, are horizontal as shown in the upper portion of FIG. 20. The transparent dots 56 in animater panel 40 are arranged along a pattern of parallel horizontal lines 58 (see lower portion of FIG. 20) which are spaced apart the same amount as diagonal lines 54 of face panel 30, and are aligned therewith when in use as in FIG. 19. Therefore, the dots 56 of animater panel 40 reciprocate along the diagonal lines 54 of the rectangular grid pattern of dots 52 in face panel 30. As is explained hereinafter, the dots 56 of animater panel 40 are arranged to form desired patterns which in this example are the letters A, B, and C.

The first step in forming the desired patterns is illustrated in FIG. 1. Separate masks 10, 14, and 16 are made of the desired patterns using a transparent film base which has a red or other opaque overlay that can be cut away with a knife or razor blade and peeled off to form any desired pattern, leaving the pattern such as the letters A, B, and C transparent. The color red has not been shown on the drawings as it might tend to confuse. Such film with a red overlay is available from Ulano Graphic Art Supply Inc. of Brooklyn, N.Y. 11238, under the trade name of "Rubylith." In addition to the desired patterns, centering holes 12 are also desirably cut in masks 10, 14, and 16 defining the horizontal and vertical center lines of the patterns. Centering holes 12 are cut with a conventional hole cutter. The desired patterns are enlarged and are later photographically reduced as described hereinafter.

Although the letters A, B, and C are used herein by way of example, it should be understood that the desired patterns will often be words or sentences that form advertising messages. In this case, masks of the desired words or sentences are formed in the same manner as the letter masks shown in FIG. 1. The same is true for pictures or designs.

In the illustrated example, the letter B is larger than the letter A and the letter C is larger than the letter B. This is to illustrate one of the special effects that is possible with the apparatus of this invention, i.e., the progressive enlargement of the words or characters as they are illuminated in sequence on the face panel. Also, the letters A, B, and C are all centered on their masks in this example, but this is not necessary. They could be spaced at different positions if desired. Masks 10, 14, and 16 are rectangular in this example, but they could be any desired shape depending on the shape of the sign, e.g., they could be long and narrow to accommodate an advertising message.

The number of patterns that can be employed is not limited to three but can be a smaller or larger number depending on the spacing of the transparent dots as described hereinafter.

After the cutout masks 10, 14, and 16 are made, they are superimposed one on top of the other with their center lines aligned, as shown in FIG. 2, and a composite form 19 is prepared from a sheet of "Rubylith" or like film as shown in FIG. 3, with the red overlay on portion 18 of the film removed and discarded. In FIG. 3, portion 19 is red. Composite form 19 follows the exterior outlines of the combined letters A, B, and C and serves to limit the number of transparent dots required in face panel 30 to those in the immediate area of the desired patterns, as will be evident later in the description. A similar composite form 21 (FIG. 4) is similarly prepared from another sheet 20 of "Rubylith" film following the combined letters A, B, and C with an enlarged border ring 21' therearound to accommodate the reciprocal movement of animater panel 40. Centerlines are marked on composite forms 19 and 21 with blue lines which are photographically invisible. The portion 21 is red in FIG. 4.

Next, negative photographic impressions as shown in FIGS. 5 and 6 at 22 and 24 of the composite forms 19 and 21 are made utilizing contact film such as Eastman Kodak Kodality Orthotype 3 or the like. In FIGS. 5 and 6 the border portions are opaque (negative black) and the indicia is transparent.

Next, an oversized rectangular grid 26 is drawn on a suitable sheet of paper to act as a guide for removing dots of the red overlay to provide the transparent dots in composite forms 19 and 21 to form face panel 30 and animater panel 40.

Rectangular grid 26 is oversized by the same factor as masks 10, 14, and 16 and the marks formed from the grid are photographically reduced later to provide a fine grid of transparent dots in an opaque background. As shown in FIG. 8, transparent dots 52 are formed at each junction of grid 26. Up to three equally spaced transparent dots 56 A, B, and C are formed on the diagonal line 54 between each adjacent pair of grid squares. If desired, the diagonal 54 could stretch between the corners of one grid square, but this would not provide room for three openings. However, in cases where an off-on sign is being prepared rather than a three pattern sign, the extending of the diagonal 54 between the corners of only one grid square is workable.

It should be noted that the three dots 56 A, B, and C on diagonal 54 in FIG. 8 fall within the rectangle defined by six dots 52. These dots 56 A, B, and C are on animater 40 while dots 52 are on face panel 30. These dots 56 A, B, and C are hidden from view as they move along diagonal 54 during reciprocation of animater panel 40 until they register with the corner dots 52. It can be seen that locating dots 56 on diagonal 54 saves space and makes it possible to utilize a much finer grid pattern than was heretofore possible. The diagonal 54 is at an angle of approximately 26° with respect to the horizontal (referring to FIG. 8), and this angle is more specifically 26°–34′.

Figure 9:
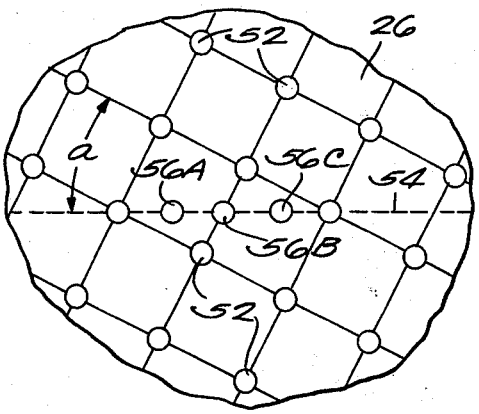
FIG. 9 is a plan view of the grid and holes of FIG. 8 with the sheet tilted at an angle A to place the diagonal line thereof in a horizontal position.
Figure 10:
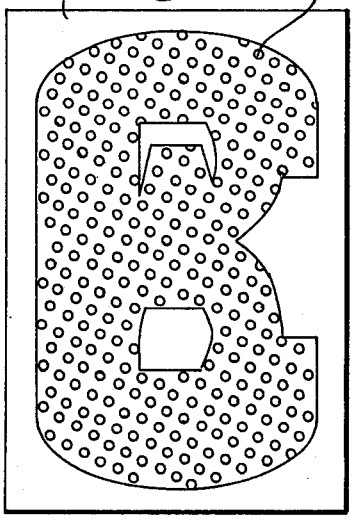
FIG. 10 is a plan view of a mask in the form of FIG. 3 with transparent dots cut therein at the corners of the grid shown in FIG. 7.

As shown in FIG. 9, it is desirable, in use, to tilt grid 26 at an angle A to place the diagonal line 54 in a horizontal position to permit horizontal reciprocation of the animater panel 40. This can be conveniently done by drawing centerline 60 (FIG. 7) and centerline 62 at the required angle (*a*) on grid 26 as shown in FIG. 7 and using centerlines 60 and 62 when preparing the transparent dots in composite forms 19 and 21.

Figure 11:
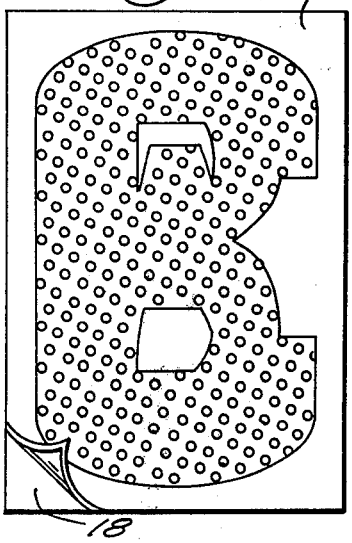
FIG. 11 is a plan view of a mask in the form of FIG. 10 with the mask of FIG. 5 superimposed thereon.
Figure 12:
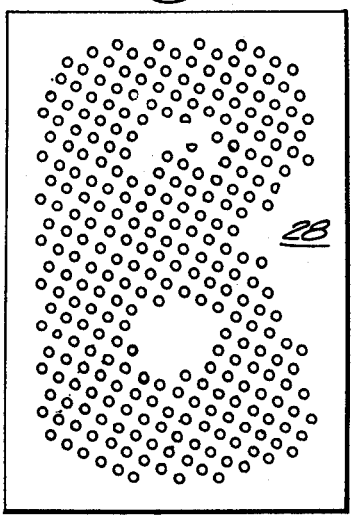
FIG. 12 is a plan view of a mask bearing a photographic negative impression of the dotted mask of FIG. 11.
Figure 13:
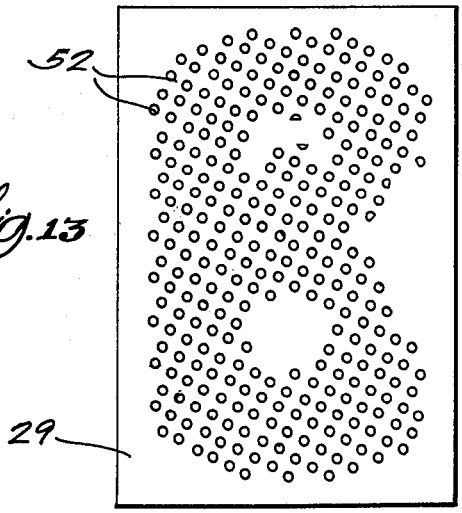
FIG. 13 is a plan view of a mask bearing a photographic negative impression of the dotted mask of FIG. 12.
Figure 14:
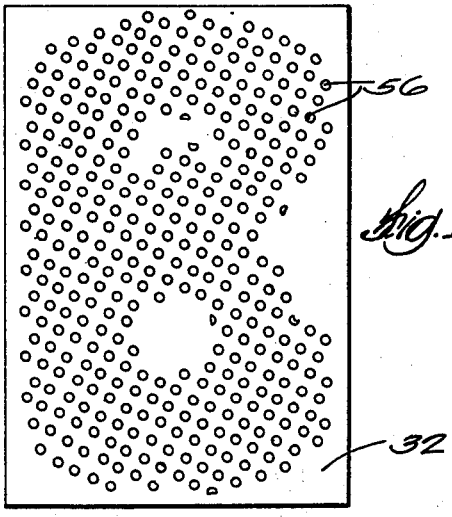
FIG. 14 is a plan view of a mask bearing a photographic negative impression of a dotted form similar to FIG. 12 but made from the mask of FIG. 4 with the mask of FIG. 6 superimposed thereon.

The next step is to place composite form 19 on grid 26 with the center lines of form 19 aligned with tilted centerlines 60 and 62. Then openings 52 (FIG. 10) are cut in the red overlay at each grid intersection with a special hole cutter. This leaves the border of FIG. 10 transparent as well as the dots, and the area between dots is red or opaque. Next, mask 22 of FIG. 5 is placed over dotted composite form 18 as shown in FIG. 11. A photographic negative contact print 28 is then made, as shown in FIG. 12, said figure having a transparent background and black dots. Next, a photographic negative contact print of print 28 is made (FIG. 13) to form print 29, which has an opaque background with transparent dots 52 thereon arranged in a tilted rectangular grid pattern such as shown in FIG. 20 (upper portion) (color not being indicated on the drawing). As can be seen in FIG. 13, the shape of the dotted form, which follows the combined outline of the letters A, B, and C, limits the openings 52 to the area of the desired patterns A, B, and C to eliminate the necessity of having unnecessary dots over the rest of the sheet.

The next portion of the fabrication process is devoted to forming the animater panel 40. For this, a dotted composite print 32 (FIG. 14) with an opaque background and transparent dots 56 is prepared by the same process described above in connection with FIGS. 10 – 13. Print 32 is prepared from composite form 20 (FIG. 4) and has the enlarged border 21′ which allows for movement of animater panel 40 in an amount equal to the width of the border 21′. Three prints 32 are prepared, one for each of the letters A, B, and C, and are overlaid by masks 10, 14, and 16 of FIG. 1 as shown in FIG. 15. Negative contact prints 34, 36, and 38 are then made from the dotted forms 32 under masks 10, 14, and 16 as shown in FIG. 16. These prints have a transparent background and black dots.

Negative prints 34, 36, and 38 are then superimposed one on top of another as shown in FIG. 17, with each print aligned on a different one of the three dots 56 A, B, or C on diagonal 54 (FIG. 9) of grid 26. This is done so that the A pattern will be illuminated when the set of dots 56 A (FIG. 9) register with dots 52. The B pattern will be illuminated when the next set of dots 56 B register with dots 52, and the C pattern will be illuminated when the third set of dots 56 C register with dots 52. After prints 34, 36, and 38 are aligned and superimposed, a negative contact print 39 (FIG. 18) of the superimposed prints is taken. Print 39 is then photographically reduced to form animater panel 40. Print 39 has an opaque background and transparent dots.

In the apparatus of FIG. 19, animater panel 40 is continuously reciprocated horizontally and this causes the letters A, B, C to be illuminated in sequence followed by the reverse sequence C, B, A; then A, B, C again, and so on. The sequence A, B, C appears as the animater panel 40 is reciprocated in one direction, and the reverse sequence C, B, A appears when animater panel 40 is reciprocated back to its starting position. If it is desired to spell out words or messages, the reverse sequence can be moved so fast that the letters are invisible in this direction. One way of causing faster movement in the reverse direction is illustrated in the modified apparatus shown in FIG. 21. In this apparatus, an animater panel 64 and face panel 66 are prepared by the above-disclosed method with the diagonal lines 54 (FIG. 20) and horizontal lines 58 being oriented vertically instead of horizontally. This is done by using axis 60 (FIG. 7) of grid 26 as the vertical axis instead of the horizontal axis of animater panel 64 and face panel 66. The numbers 1, 2, 3 are used in this example instead of the letters A, B, C. A specially shaped opening 68 is formed in animater panel 64 so that rotation of eccentric pin 48 by electric motor 46 causes vertical reciprocation of animater panel 64, the panel 64 moving upwardly at the relatively slow upward speed of pin 48 and then falling back to its initial position very quickly under the influence of gravity. Pin 48 engages an upper edge 70 of opening 68 when it moves panel 64 upwardly. At the top of the upward movement, pin 48 moves into a vertical slot 72 that allows panel 64 to move downwardly freely under the influence of gravity back to its starting position. During the upward movement, the numbers 1, 2, 3 are illuminated and extinguished in sequence, each number being extinguished before the succeeding number is illuminated. During the downward movement, the reverse sequence 3, 2, 1 occurs but the reverse sequence flashes on and off too fast to be perceived by the viewer. So the viewer sees the sequence 1, 2, 3, followed by a pause, then the sequence 1, 2, 3 again, followed by a pause, and so on. The pause is the time interval required for pin 48 to rotate out of slot 72 and back into contact with edge 70 of opening 68. The application of this example to the spelling of words, or to the display of words or phrases in sequence, will be obvious to those skilled in the art.

In the foregoing examples utilizing three different patterns, there are five different steps to the operating sequence. In the first step, the face panel is dark, none of the transparent dots in the face panel and animater panel being registered. In the next three steps, the three different patterns are illuminated in sequence as described above. In the last step, the face panel is dark again. If desired, the first and fifth steps could be illuminated patterns, which would make it possible to use five different patterns instead of three without changing the number of openings 56 on diagonal 54 of FIG. 9. Further increases in the number of different patterns would require more dots 56, which would require either a coarser grid 26 or smaller dots 52 and 56. Decreases in the number of different patterns used would allow a finer grid 26 or larger dots 52 and 56.

Various changes and modifications may be made without departing from the spirit of the invention and all of such changes are contemplated as may come within the scope of the following claims.

What I claim is:

1. An illuminated animated sign comprising a source of light, a first panel having an opaque background and an array of transparent dots of like size thereon, a second panel having an opaque background and an array of transparent dots thereon of substantially the same size as the dots of the first panel, said panels being in superimposed relationship on one side of said light source, one of said panels being mounted for reciprocal movement along a straight line relative to the other panel, the array of transparent dots on the first panel being arranged in a square grid pattern, the array of transparent dots of said second panel being positioned along diagonal lines, each of said diagonal lines being the diagonal of rectangles on said first panel, each of which rectangles is formed by two adjacent squares which are defined by six dots, each diagonal line of dots on said second panel is at an angle of approximately 26° with respect to the long sides of said six dot rectangles of the first panel the transparent dots of said second panel being arranged to form a plurality of patterns which are periodically illuminated when the transparent dots of the second panel register with the transparent dots dots of the first panel, and means for reciprocally moving one of said panels in such a direction that the transparent dots of the second panel move on the beforementioned diagonal lines with respect to the transparent dots which form said grid pattern on said first panel, whereby a maximum number of dots on a diagonal line of said second panel is accommodated between the diagonally opposite corner dots of each of said six dot rectangles of said first panel in positions where they may be moved in sequence along said diagonal lines into registration with one of said corner dots without overlapping any of the other dots defining a six dot rectangle, there are at least three transparent dots on said second panel positioned on a diagonal line between diagonally opposite transparent dots of said six dot grid pattern on said first panel, the transparent dots on said second panel being arranged to form at least three different patterns which are periodically illuminated in sequence as said one panel is reciprocated with respect to the other panel.

2. The sign of claim 1 in which said movable panel is mounted for movement along a straight horizontal line relative to the other panel.

3. The sign of claim 1 in which said movable panel is mounted for movement along a straight vertical line relative to the other panel.

4. The sign of claim 1 wherein the grid pattern of transparent dots in said first panel is tilted to place the diagonal lines thereof in the line of reciprocal movement of the movable panel.

5. The sign of claim 1 in which said angle is 26°– 34′.

* * * * *